US006609884B2

(12) United States Patent
Harvey

(10) Patent No.: US 6,609,884 B2
(45) Date of Patent: Aug. 26, 2003

(54) COOLING OF GAS TURBINE ENGINE AEROFOILS

(75) Inventor: Neil W Harvey, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/968,799

(22) Filed: Oct. 3, 2001

(65) Prior Publication Data

US 2002/0106275 A1 Aug. 8, 2002

(30) Foreign Application Priority Data

Oct. 12, 2000 (GB) ..... 0025012

(51) Int. Cl.[7] ..... F01D 5/18; F01D 9/06
(52) U.S. Cl. ..... 415/115; 416/97 R
(58) Field of Search ..... 416/97 R; 415/115

(56) References Cited

U.S. PATENT DOCUMENTS 4,505,639 A * 3/1985 Groess et al. ..... 416/97 R
4,565,490 A * 1/1986 Rice ..... 415/115
5,603,606 A * 2/1997 Glezer et al. ..... 416/97 R
5,704,763 A * 1/1998 Lee ..... 415/115
6,033,181 A * 3/2000 Endres et al. ..... 416/97 R
6,099,251 A * 8/2000 LaFleur ..... 416/97 R
6,431,832 B1 * 8/2002 Glezer et al. ..... 416/97 R

* cited by examiner

*Primary Examiner*—Edward K. Look
*Assistant Examiner*—Igor Kershteyn
(74) *Attorney, Agent, or Firm*—W. Warren Taltavull; Manelli Denison & Selter PLLC

(57) ABSTRACT

An aerofoil (39) for a gas turbine engine (10) includes one or more internal cooling passage (74,76) for receiving a flow of cooling fluid, and means (84,86,88,90) for inducing at least two vortices in cooling fluid flowing through each cooling passage. Fluid within the vortices has a radially outwards, screw-type motion. The two vortices produce effective cooling of the aerofoil, which may be an aerofoil of a turbine blade.

19 Claims, 5 Drawing Sheets

COOLING OF GAS TURBINE ENGINE AEROFOILS

FIELD OF THE INVENTION

The invention relates to the internal cooling of gas turbine engine aerofoils and particularly but not exclusively to the cooling of turbine aerofoils.

BACKGROUND OF THE INVENTION

Modern gas turbines operate with high turbine entry temperatures to achieve high thermal efficiencies. These temperatures are limited by the turbine vane and blade materials. Cooling of these components is needed to allow their operating temperatures to exceed the materials' melting points without affecting the vane and blade integrity.

A large number of cooling systems are now applied to modern high temperature gas turbine vanes and blades. Cooling is achieved using relatively cool air bled from the upstream compressor system, the air bypassing the combustion chamber between the last compressor and first turbine. This air is introduced into the turbine vanes and blades where cooling is effected by a combination of internal convective cooling and external film cooling.

In film cooling a protective blanket of cooling air is ejected onto the external surface of the turbine vane or blade, from internal passages within the aerofoils, by means of holes or slots in the surface. The aim is to minimise the external heat transfer from the hot gas stream into the component surface.

In convective cooling the air is passed through passages within the aerofoil. This cools the metal since the air temperature is below that of the metal. Effectively the turbine component itself acts as a heat exchanger.

Unfortunately bleeding air from the compressor to cool the turbine reduces the overall cycle efficiency of the gas turbine engine. In addition, film cooling by ejecting air onto the turbine component surface causes aerodynamic losses in the turbine itself. Thus improvements in the performance of cooling systems continue to be sought—either to cool the turbine at a given inlet temperature with less cooling air (improving cycle and turbine efficiencies), or to enable higher inlet temperatures to be sustained with the existing levels of cooling air consumption.

SUMMARY OF THE INVENTION

According to the invention, there is provided an aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of openings are provided in the wall for feeding cooling fluid from the feed passage into the cooling passage, to induce at least two vortices in cooling fluid flowing through the cooling passage.

Preferably the openings are angled such that fluid flowing therethrough has a component of movement in a direction parallel to the cooling passage.

Preferably, the internal wall includes two sets of openings, each set including a plurality of openings generally aligned in a direction parallel to the cooling passage, and each set of openings providing means for inducing a vortical flow of fluid in the cooling passage.

Preferably each set of openings extends along substantially the whole of the length of the cooling passage. The openings may be positioned so as to induce two generally parallel, adjacent vortices.

The cooling passage may be bounded along its length by further elongate walls, the further walls having substantially no openings therein, and at least one wall comprising a part of an outer wall of the aerofoil. Preferably the openings are located and oriented such that fluid flowing into the cooling passage initially flows along an inner surface of the outer wall of the aerofoil. Preferably one set of openings is oriented and located such that fluid flowing therethrough and into the cooling passage initially flows along the inner surface of a wall forming a suction side wall of the aerofoil and the other set of openings is oriented and located such that fluid flowing therethrough and into the cooling passage initially flows along the inner surface of a wall forming a pressure side wall of the aerofoil.

One set of openings may be located and oriented to induce a vortex which rotates in a first direction and the other set of openings may be located and oriented to induce a vortex which rotates in the opposite direction.

Preferably fluid within one vortex flows initially along the inner surface of the wall forming a suction side wall of the aerofoil and subsequently along an internal wall of the aerofoil and fluid within the other vortex flows initially along the inner surface of the wall forming a pressure side wall of the aerofoil and subsequently along the same internal wall of the aerofoil, the two fluid-flows meeting at a central region of the internal wall.

The openings in the wall may be located and oriented to induce a vortex having a screw-type motion, with a component of movement in a direction parallel to the cooling passage. Inner surfaces of walls of the cooling passage may be provided with ribs aligned with the screw-type path of motion of the fluid within the vortex.

Preferably, the feed passage is located in a leading or trailing edge of the aerofoil and the cooling passage is located in an internal region of the aerofoil. The aerofoil may include a feed passage at its leading edge, a feed passage at its trailing edge and two cooling passages located therebetween, each cooling passage being fed with cooling fluid from an adjacent feed passage.

Preferably the aerofoil is adapted to be oriented in a generally radial direction of the gas turbine engine and the cooling passage extends generally in the radial direction of the gas turbine engine when the aerofoil is so oriented. The aerofoil may comprise a part of a turbine blade for the gas turbine engine, adapted to be mounted on a rotor disc so as to extend radially therefrom. The turbine blade may include a root portion for mounting on the disc, the root portion including a passage through which fluid may pass to the feed passage.

Alternatively the aerofoil may comprise a part of a turbine stator or a nozzle guide vane for the gas turbine engine.

According to the invention, there is further provided a gas turbine engine including an aerofoil according to any of the preceding definitions.

According to the invention, there is further provided a method of cooling an aerofoil for a gas turbine engine, the aerofoil including an elongate internal cooling passage, wherein the method includes the step of providing a flow of cooling fluid in the passage and inducing at least two vortices in the fluid. The fluid within each vortex may have a screw-type motion, with a component of movement in a direction parallel to the cooling passage.

BRIEF DESCRIPTION OF THE DRAWINGS

An embodiment of the invention will be described for the purpose of illustration only, with reference to the accompanying drawings, in which.

DETAILED DESCRIPTION OF THE INVENTION

Figure 1:
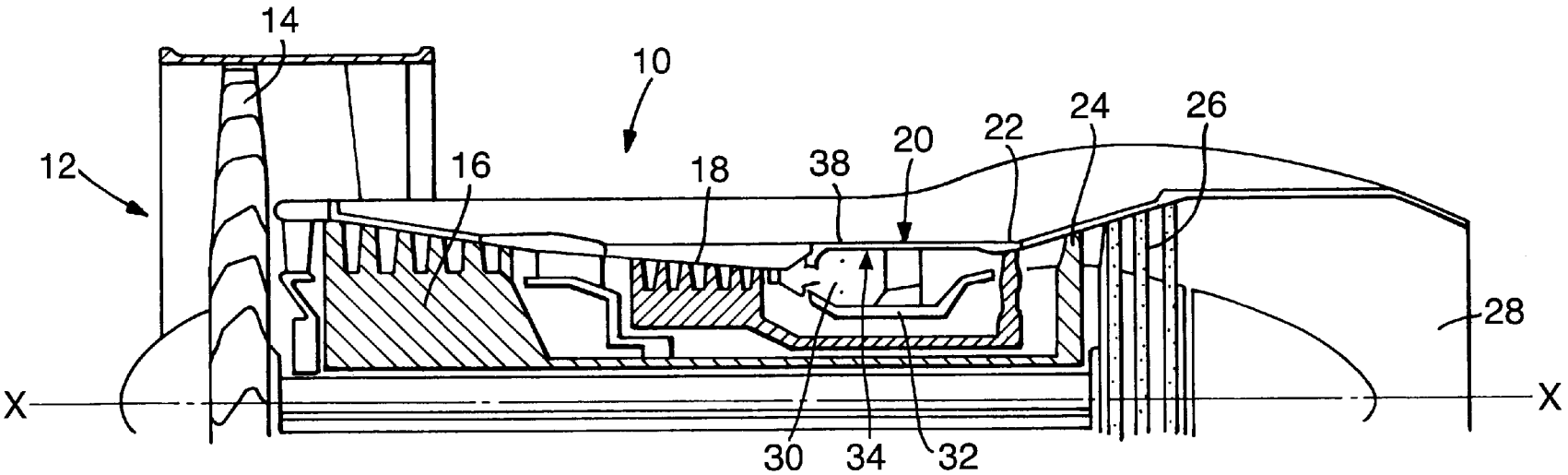
FIG. 1 is a diagrammatic sectional view of a ducted fan gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
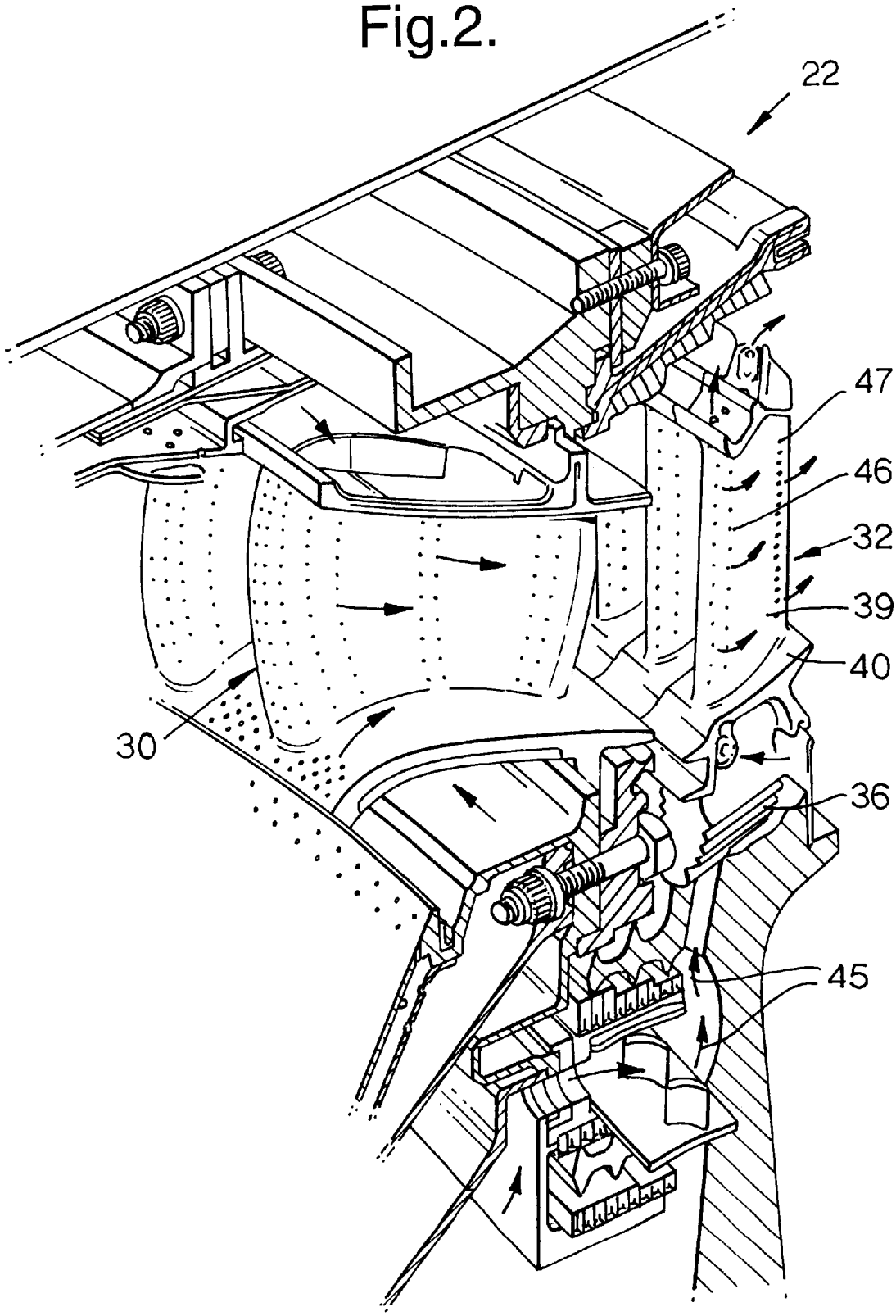
FIG. 2 is a diagrammatic perspective view of a nozzle guide vane and turbine arrangement, illustrating the flow of cooling air.

Referring to FIG. 2, the high pressure turbine stage 22 of the gas turbine engine 10 includes a set of stationary nozzle guide vanes 30 and a set of rotatable turbine blades 32. The set of nozzle guide vanes 30 and the set of turbine blades 32 are each mounted generally in a ring formation, with the vanes and the turbine blades extending radially outwardly. Gases expanded by the combustion process in the combustion equipment 20 force their way into discharge nozzles (not illustrated) where they are accelerated and forced onto the nozzle guide vanes 30, which impart a "spin" or "whirl" in the direction of rotation of the turbine blades 32. The gases then impact the turbine blades 32, causing rotation of the turbine.

The turbine blades 32 are mounted on a turbine disc 34 by means of "fir tree root" fixings. A root portion 36 of each blade 32 is freely mounted within a recess when the turbine is stationary, but the connection is stiffened by centrifugal loading when the turbine is rotating.

Each turbine blade 32 includes an aerofoil 39 which extends into the working gases flowing axially through the turbine. A blade platform 40 extends circumferentially from each turbine blade 32 at the base of its aerofoil and the blade platforms 40 of adjacent turbine blades abut each other so as to form a smooth annular surface.

The high thermal efficiency of the engine is dependent upon the gases entering the turbine at high temperatures and cooling of the nozzle guide vanes and turbine blades is thus very important. Continuous cooling of these components allows their environmental operating temperatures to exceed the melting points of the materials from which they are formed. The arrows in FIG. 2 give an indication of the flow of cooling air in a typical air cooled high pressure nozzle guide vane and turbine blade arrangement. The dark arrows represent high pressure air which is bled from the upstream compressor system, bypassing the combustion chamber. The high pressure air is used for cooling and has a temperature which may be as low as 900 k. The light arrows represent low pressure, leakage air.

Figure 3A:
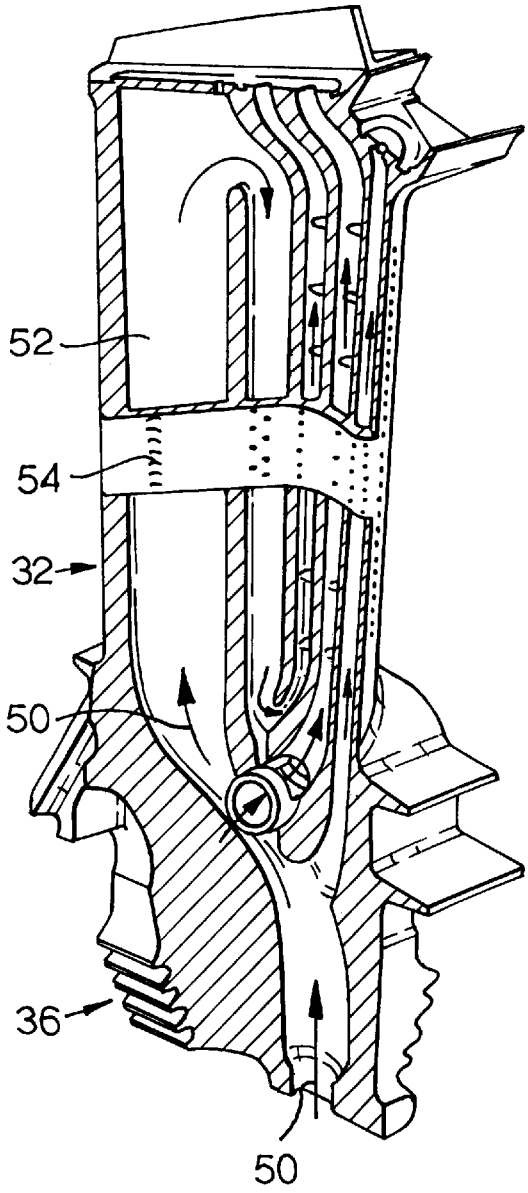
FIGS. 3A and 3B are diagrammatic perspective views of prior art turbine blades of the multi-pass design, FIG. 3A being cut away to show the cooling passages.
Figure 3B:
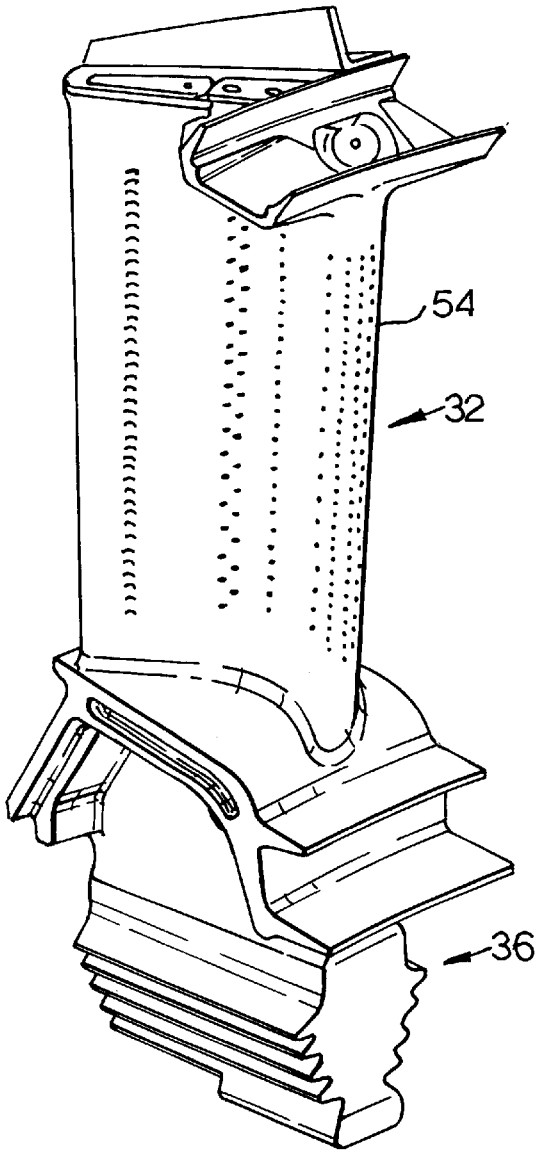

Referring to FIGS. 3A and 3B, there is illustrated a prior art turbine blade 32 of the "multi-pass" type. It may be seen that high pressure air, indicated by the arrows 50, is fed up through the root portion 36 of the blade 32 to an internal region of the blade. The blade 32 employs convective cooling, in which the air is passed through internal passages 52. The blade 32 also employs film cooling, in which a protective blanket of cooling air is ejected onto an external surface of the blade through orifices 54. This minimises the external heat transfer from the hot gas stream into the turbine blade's surface.

Turbine Convective Cooling

Two concepts are important in assessing the operation of a cooling system—its effectiveness and its efficiency.

The effectiveness $\lambda$ is a function of how well the cooling system reduces the temperature of the component. One definition of convective cooling effectiveness is:

$$\lambda = \frac{T_g - T_m}{T_g - T_{cl}}$$

where $T_g$ is the external (driving) gas temperature $T_{cl}$ is the temperature of the cooling air supplied to the component $T_m$ is the average metal temperature Examination of this equation shows that if the cooling is ineffective ($\lambda$=0) then the metal temperature is at the external gas temperature. The best cooling achievable ($\lambda$=1) lowers the metal temperature to that of the coolant flow.

The efficiency $\eta$ of a cooling system is a measure of how well the cooling flow is being used in achieving a given effectiveness. One definition, taken from heat exchanger theory, is:

$$\eta = \frac{T_{c2} - T_{cl}}{T_m - T_{cl}}$$

where $T_{c2}$ is the temperature of the coolant as it exits the turbine component (usually by ejection at some location from the component surface). For maximum efficiency ($\eta$=1) the coolant exit temperature rises to that of the component metal $T_m$.

In the "multi-pass" blade shown in FIG. 3, the long flow path in the rear portion of the rotor blade gives high cooling efficiency. The final (third) pass of this "triple" includes another feature common to modern cooled turbine components—"turbulators" or transverse ribs. These enhance the local internal heat transfer, increasing cooling effectiveness, which is needed in this case to compensate for the rise in the coolant temperature (which must occur if high cooling efficiencies are to be achieved).

The use of features such as turbulators has the drawback that it increases the pressure loss of the coolant flow. In practice the allowable pressure loss of the coolant, which will arise to some extent anyway from frictional forces on the internal surfaces, may be limited depending on where the coolant is ejected from the component surfaces. High internal pressure losses may also contribute to some extent to a reduction in the overall aerodynamic performance of the cooled turbine. However, depending on the overall optimisation of the cooling system design, it may be desirable to trade higher pressure losses (giving higher level of effectiveness and efficiencies) for a lower coolant mass flow.

Some very recent proposed designs try to achieve this by having many, very small internal cooling passages often inter-linked to give a long flow path for the coolant. The small passages give high coolant velocities and high internal heat transfer (and thus high effectiveness), while the long flow paths give high cooling efficiency. The pressure losses of the coolant flow are high but the mass flow is reduced relative to the conventional multi-pass systems mentioned previously. Although such designs offer very good cooling, they are inevitably heavier and more expensive than a comparable "multi-pass" design.

Figure 4:
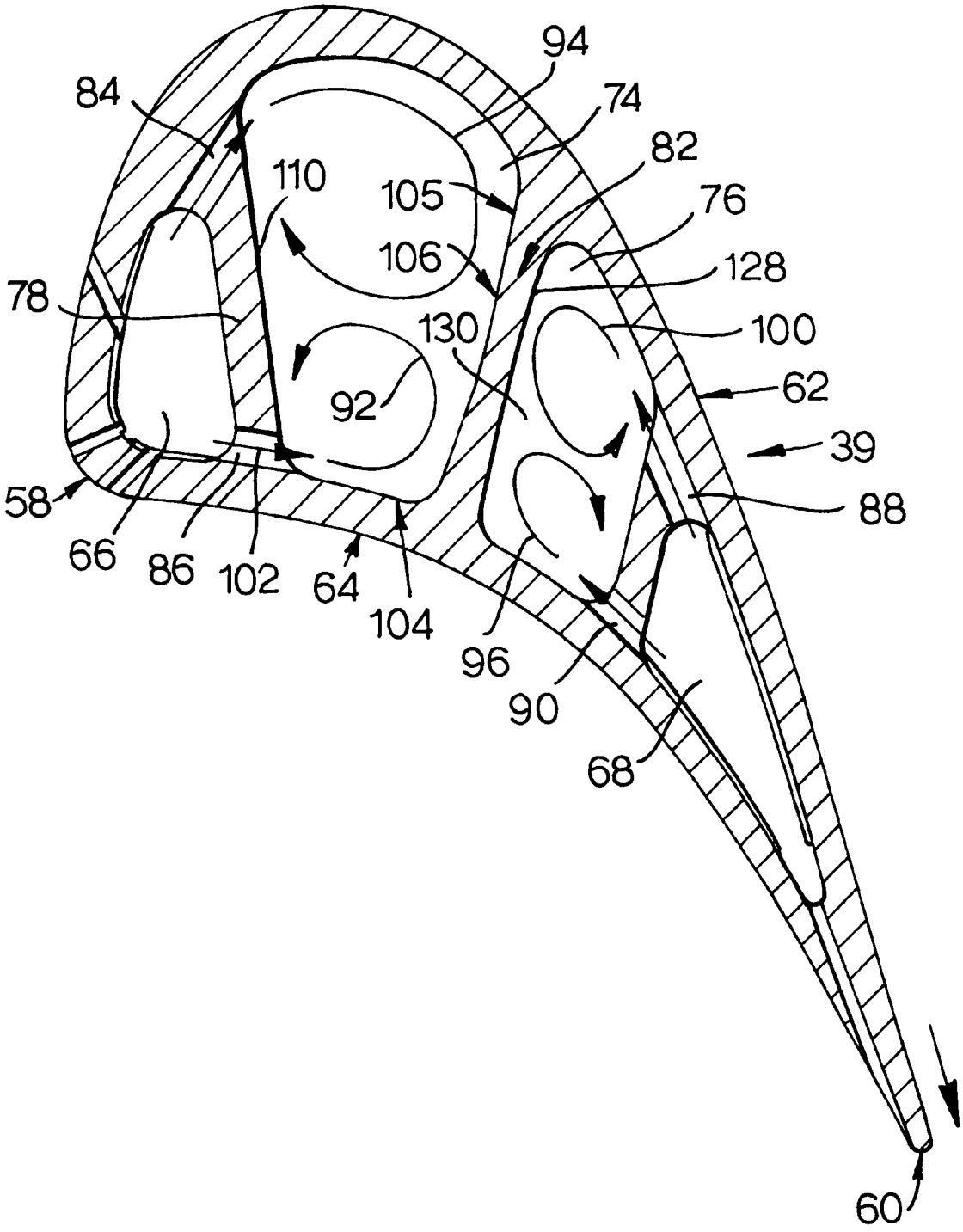
FIG. 4 is a diagrammatic section through the aerofoil of a turbine blade according to the invention.
Figure 5:
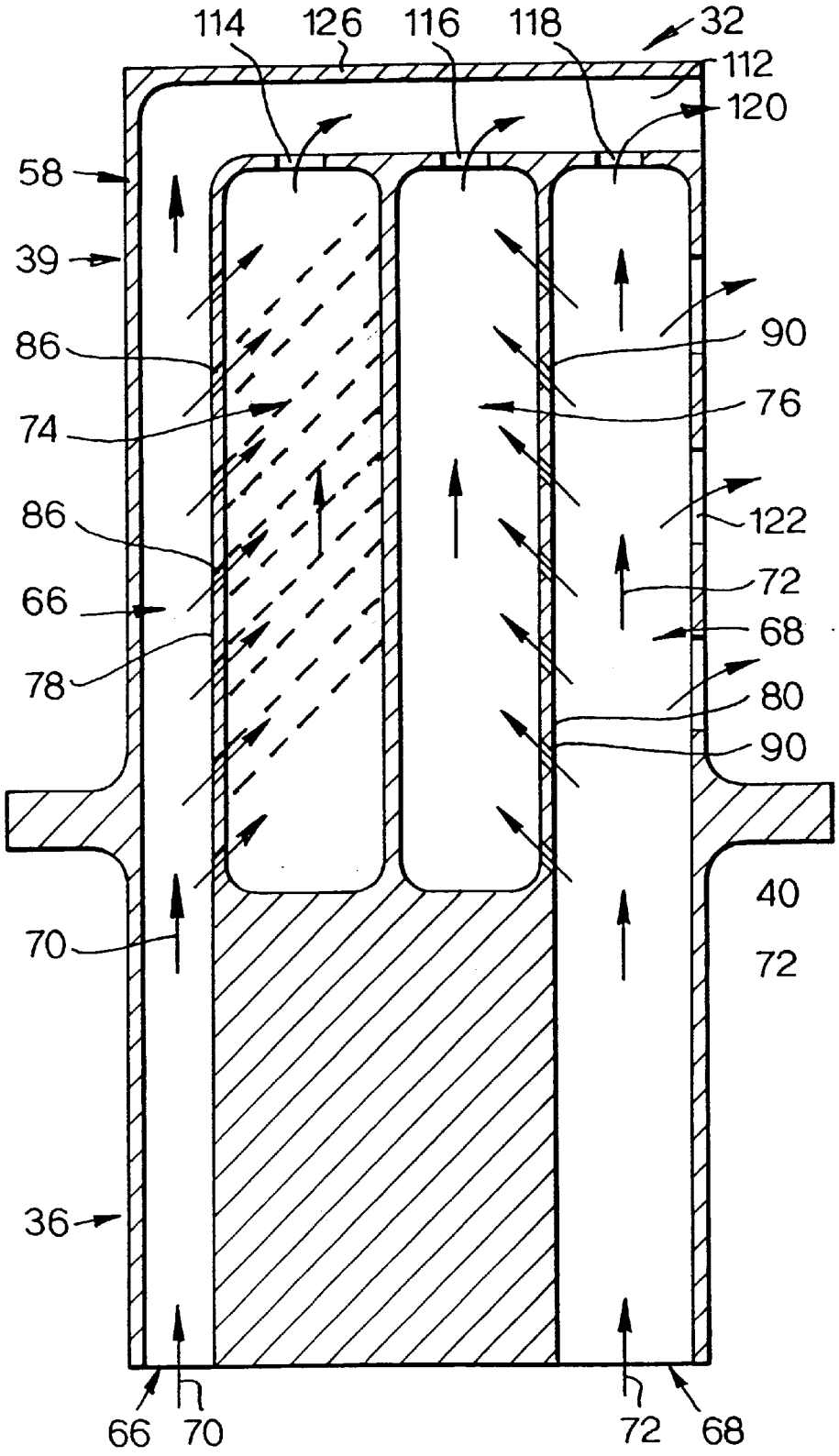
FIG. 5 is a diagrammatic radial section through a turbine blade according to the invention.

FIGS. 4 and 5 illustrate a turbine rotor blade 32 according to the invention. FIG. 4 is a cross section through the rotor aerofoil 39 and FIG. 5 is a cutaway elevation through the turbine blade 32, viewed on the pressure surface but with the pressure side wall removed.

The turbine blade aerofoil 39 has a leading edge 58 and a trailing edge 60. Joining the leading and trailing edges 58 and 60 are a generally convex suction side wall 62 and a generally concave pressure side wall 64. The aerofoil 39 has a generally hollow interior, which is bounded by the suction side wall 62 and the pressure side wall 64, the walls having substantially the same thicknesses.

The blade 32 is provided with a number of elongate internal cooling passages, which extend along the length of the blade, in the radial direction of the blade in use. In the illustrated embodiment, two radial passages are fed with cooling air directly from the root of the rotor. These are a leading edge feed passage 66 and a trailing edge feed passage 68, both feed passages extending through the root portion 36 and the aerofoil 39 of the blade 32. The arrows 70 in FIG. 5 indicate the flow of coolant through the leading edge feed passage 66 and the arrows 72 indicate the flow of coolant through the trailing edge feed passage 68.

The blade 56 further includes first and second elongate internal "vortex cooling" passages 74 and 76 which are generally parallel to, and which extend alongside, the feed passages. The vortex cooling passages 74 and 76 extend through the aerofoil 39 only, and do not extend into the root portion 36 of the blade 32.

An internal web 78 separates the leading edge feed passage 66 from the first vortex cooling passage 74 and an internal web 80 separates the trailing edge feed passage 68 from the second vortex cooling passage 76. A central internal web 82 separates the two vortex cooling passages 74 and 76 from one another.

Along its length, the leading edge feed passage 66 is thus bounded by internal surfaces of the suction side wall 62 and the pressure side wall 64, and by a surface of the internal web 78. The trailing edge feed passage is bounded by internal surfaces of the suction side wall 62 and the pressure side wall 64 and by a surface of the internal web 80. The two vortex cooling passages are each bounded by internal surfaces of the suction and pressure side walls 62 and 64 and by respective surfaces of the internal webs 78, 80 and 82.

The internal web 78 is provided with two rows of openings 84 and 86, in the form of holes or slots. The openings within each row are generally aligned with each other in the radial direction of the blade. The openings 84 within one row are adjacent to and generally parallel/tangential to the suction side wall 62 of the blade 56, while the openings 86 in the other row are adjacent to and generally parallel/tangential to the pressure side wall 64 of the blade (see FIG. 4).

Similar rows of openings 88 and 90 are provided in the internal web 80. The openings 88 are adjacent to and generally parallel/tangential to the suction side wall 62 of the aerofoil and the openings 90 are adjacent to and generally parallel/tangential to the pressure side wall 64 of the aerofoil.

Referring to FIG. 5, the openings 84, 86, 88, 90 lie at an angle of between 40° and 50° to the radial direction of the passages, such that air passing through the openings from a feed passage into a vortex cooling passage has a radially outwards component of motion.

Referring initially to the vortex cooling passage 74, coolant air from the leading edge feed passage 66 is fed through the two rows of openings 84 and 86 in the internal web 78, into the vortex cooling passage 74. Referring to FIG. 4, the position of the openings 84 and 86 results in the setting up of two counter-rotating vortices 92 and 94 in the passage 74. Each vortex has a circular and radially outward screw type motion. The counter-rotation of the two vortices results in their motion mutually reinforcing each other.

Similar vortices 96 and 100 are set up in the vortex cooling passage 76, coolant air flowing into that passage from the trailing edge feed passage 68, through the openings 88 and 90.

The action of the vortical flow in the vortex cooling passages 74 and 76 significantly enhances heat transfer. Referring to one vortex 92, as coolant flow 102 is injected into the passage 74, high velocity, low temperature coolant flows along an inner surface 104 of the pressure side wall 64. The coolant flows vertically and radially outwardly at a pitch angle dependent upon the radial angle of the injection opening 84, and to some extent on the previously injected flow that has built up in the passage and is moving radially outwardly. As the coolant 102 moves over the passage inner surface 104, it forms a boundary layer which loses total pressure due to the friction on the inner surface 104. The boundary layer also increases in temperature as heat flows into the coolant through the wall 64. The nature of the enclosed vortex 92 is such that the highest velocity fluid is found in its outer part and this gives high heat transfer at the passage inner surface 104.

The vortical flow continues around the passage 74 with the boundary layer growing as it moves from the inner surface 104 of the pressure side wall 64 to an inner surface 105 of the central internal web 82. At about the middle of the central internal web 82, the flow within the vortex 92 meets the corresponding flow within the other vortex 94 in the passage 74. The meeting occurs approximately at point 106 in FIG. 4.

As the boundary layers of the two vortices 92 and 94 meet, they stagnate and are forced to separate off the inner surface 105 of the central internal web 82. The natural action of the vortex is for low energy fluid to move into the core of the vortex. Thus, because the boundary layers have incurred a loss of total pressure, the fluid in the boundary layers moves towards the core of the vortex. The fluid in the boundary layers has picked up heat from the aerofoil wall and in this way the vortex acts to keep high energy, relatively cool fluid near the inner surfaces of the walls of the passage 74.

The high energy, relatively cool, fluid at the outer region of the vortex is forced through a middle region of the cooling passage 74 and then impinges onto an inner surface 110 of the internal web 78. This forms a new boundary layer on the inner surface 110 of the web. However, the new boundary layer is thin and gives high heat transfer.

The boundary layer grows again on the inner surface 110 and then the inner surface 104 before flowing onto the inner surface 106 of the central internal web 82 and separating off once again. This continues until the energy of the vortex is spent or, as in a properly designed cooling system, new coolant is injected from the openings 84 and 86 to replenish the vortex. When coolant 102 is injected, this has the effect of blowing off from the inner surface 104 any boundary layer that was moving from surface 110 to surface 104 and the boundary layer fluid is caught in the vortex, and moves to its core.

The vortices 96 and 100 behave in a similar manner, the boundary layers separating off the internal surface 128 of the wall 82, at about point 130.

Other than the internal webs 80 and 82, the surfaces which bound the vortex cooling passages do not include any openings, in order that the vortex flow is not interrupted.

The coolant used in the vortex cooling passages 74 and 76 has to be ejected from the rotor blade 56. In the embodiment shown in the figures, the rotor blade 56 has an internal, generally chordwise flowing tip gallery 112 into which spent coolant flows from the vortex cooling passage 74 via a hole 114 and from the vortex cooling passage 76 via a hole 116. In addition, the leading edge feed passage 66 flows into the tip gallery 112 and coolant from the trailing edge passage 68 flows into the tip gallery 112 via a hole 118. All this fluid is ejected as flow 120 from the trailing edge 60 of the rotor blade 56. In this embodiment, cooling of the leading edge 58 and trailing edge 60 extremities is effected by conventional film cooling holes 122 fed from the feed passages 66 and 68.

In an alternative embodiment, the spent coolant could be ejected from one or more of the passages via "dust-holes" in the rotor tip 126.

Gas turbine engine aerofoils are generally of cast construction, and the openings 84 to 90 may be formed during the casting process. They would form part of the soluble ceramic core of the cooling geometry and would have the advantage of helping to stiffen the ceramic core and thereby reducing unwanted distortion of its shape that might occur during the casing process.

There is thus provided an aerofoil for a gas turbine engine, in which high cooling effectiveness and efficiency is achieved. Only relatively low coolant mass flow is required as the high fluid velocities at the inner surfaces of the passages are generated by the vortical nature of the coolant flow. In this cooling system the fluid velocities are largely determined by the pressure ratio across the openings 84 to 90. In conventional cooling systems, the fluid velocities in the cooling passages are a function of the ratio of the coolant mass flow to the passage cross sectional area. This is because the coolant simply flows radially, normal to the passage cross section. Velocities can only be increased by reducing passage area or increasing mass flow. In contrast in a vortex cooling system, high fluid velocities can be achieved with large cross sectional area radial passages, which keeps the rotor blade weight down to near that of a conventional multi-pass design.

Various modifications may be made to the above described embodiment without departing from the scope of the invention. More or fewer cooling passages could be used. Preferably each radial passage with vortex cooling should be fed from a passage that is itself directly fed from the root of the rotor blade. However, it is possible for one such feed passage to supply two vortex cooling passages, one on each side of it. The feed passage would then have four rows of openings leading from it.

The invention should preferably not be used where it is required to bleed film cooling holes from what would be a vortex cooling passage. This would have the effect of bleeding off the high energy fluid from the outer part of the vortex, causing the system to fail. Thus, for a turbine rotor blade with leading edge film cooling and/or ejection of coolant from trailing edge openings, vortex cooling should preferably not be used in the leading or trailing edge radial passages. The dual vortex cooling system is preferably used to convectively cool that portion of a turbine rotor blade that lies between the leading and trailing edges, but not the leading and trailing edges themselves.

The openings 84 to 90 may extend along the full radial extent of the radial passages or may extend only along a part of the radial extent. Matched rows of openings, such as 84 and 86, will usually have substantially the same radial extents.

In an alternative embodiment, it is proposed to place ribs 140 on the inner surfaces of the cooling passages, the ribs 140 being generally aligned with the cork-screwing motion of the vortices. This would have the effect of increasing the internal wetted area and thus the total heat transfer from the inner surface.

Although the invention has been described in relation to a turbine rotor blade, it could be applied to static components, principally stators or nozzle guide vanes.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of opening are provided in the wall for feeding cooling fluid from the feed passage into the cooling passage, to induce at least two vortices in cooling fluid flowing through the cooling passage, the internal wall including two sets of said openings, each set including a plurality of said openings generally aligned in a direction parallel to the cooling passage, and each set of said openings providing means for inducing a vortical flow of fluid in the cooling passage.

2. An aerofoil according to claim 1, wherein the openings are angled such that fluid flowing therethrough has a component of movement in a direction parallel to the cooling passage.

3. An aerofoil according to claim 1 wherein each set of said openings extends along substantially the whole of the length of the cooling passage.

4. An aerofoil according to claim 1, wherein the openings are positioned so as to induce two generally parallel, adjacent vortices.

5. An aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of opening are provided in the wall for feeding cooling fluid from the feed passage into the cooling passage, to induce at least two vortices in cooling fluid flowing through the cooling passage, the cooling passage being bounded along its length by further elongate walls, the further walls having substantially no openings therein, and at least one wall comprising a part of an outer wall of the aerofoil.

6. An aerofoil according to claim 5, wherein the openings are located and oriented such that fluid flowing into the cooling passage initially flows along an inner surface of the outer wall of the aerofoil.

7. An aerofoil according to claim 6, wherein one set of openings is oriented and located such that fluid flowing therethrough and into the cooling passage initially flows along the inner surface of a wall forming a suction side wall of the aerofoil and wherein the other set of openings is oriented and located such that fluid flowing therethrough and into the cooling passage initially flows along the inner surface of a wall forming a pressure side wall of the aerofoil.

8. An aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of opening are provided in the wall for feeding cooling fluid from the feed passage into the cooling passage, to induce at least two vortices in cooling fluid flowing through the cooling passage, one set of openings being located and oriented to induce a vortex which rotates in a first direction and the other set of openings being located and oriented to induce a vortex which rotates in the opposite direction.

9. An aerofoil according to claim 8, wherein fluid within one vortex flows initially along the inner surface of a wall forming a suction side wall of the aerofoil and subsequently along an internal wall of the aerofoil and fluid within the other vortex flows initially along the inner surface of a wall forming a pressure side wall of the aerofoil and subsequently along the same internal wall of the aerofoil, the two fluid-flows meeting at a central region of the internal wall.

10. An aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of opening are provided in the wall for feeding cooling fluid from the feed passage into the cooling passage, to induce at least two vortices in cooling fluid flowing through the cooling passage, the openings being located and oriented to induce a vortex having a screw-type motion, with a component of movement in a direction parallel to the cooling passage.

11. An aerofoil according to claim 10, wherein inner surfaces of walls of the cooling passage are provided with ribs aligned with the screw-type path of motion of the fluid within the vortex.

12. An aerofoil for a gas turbine engine, the aerofoil including an elongate internal cooling passage for receiving a flow of cooling fluid and an elongate internal feed passage extending at least partially alongside the cooling passage, the cooling passage and the feed passage being separated by an elongate internal wall, wherein a plurality of opening are provided in the wall for feeding cooling fluid from the feed passage into the cooling passage, to induce at least two vortices in cooling fluid flowing through the cooling passage, the feed passage being located in one of the leading and trailing edge of the aerofoil and the cooling passage being located in an internal region of the aerofoil.

13. An aerofoil according to claim 12, the aerofoil including a feed passage at its leading edge, a feed passage at its trailing edge and two cooling passages located therebetween, each cooling passage being fed with cooling fluid from an adjacent feed passage.

14. An aerofoil according to claim 1, the aerofoil being adapted to be oriented in a generally radial direction of the gas turbine engine, wherein the cooling passage extends generally in the radial direction of the gas turbine engine when the aerofoil is so oriented.

15. An aerofoil according to claim 14, the aerofoil comprising a part of a turbine blade for the gas turbine engine, adapted to be mounted on a rotor disc so as to extend radially therefrom.

16. An aerofoil according to claim 15, the turbine blade including a root portion for mounting on the disc, the root portion including a passage through which fluid passes to the feed passage.

17. An aerofoil according to claim 14, wherein the aerofoil comprises a part of a turbine stator or a nozzle guide vane for the gas turbine engine.

18. A gas turbine engine including an aerofoil according to claim 1.

19. A method of cooling an aerofoil for a gas turbine engine, the aerofoil including an elongate internal cooling passage, wherein the method includes the step of providing a flow of cooling fluid in the passage and inducing at least two vortices in the fluid, the fluid within each vortex having a screw-type motion, with a component of movement in a direction parallel to the cooling passage.

* * * * *